US005391210A

United States Patent [19]

Bilkadi et al.

[11] Patent Number: 5,391,210

[45] Date of Patent: Feb. 21, 1995

[54] ABRASIVE ARTICLE

[75] Inventors: Zayn Bilkadi, Mahtomedi; Thomas P. Klun, Lakeland, both of Minn.

[73] Assignee: Minnesota Mining and Manufacturing Company, St. Paul, Minn.

[21] Appl. No.: 168,655

[22] Filed: Dec. 16, 1993

[51] Int. Cl.[6] ..... C09K 3/14

[52] U.S. Cl. ..... 51/298; 51/295; 51/307; 51/309

[58] Field of Search ..... 51/307, 309, 295, 298; 428/323, 327, 329, 331; 523/149; 524/786, 790

[56] References Cited

U.S. PATENT DOCUMENTS

| | | | |
|---|---|---|---|
| 2,958,593 | 11/1960 | Hoover et al. | 51/295 |
| 3,631,638 | 1/1972 | Yoshikawa et al. | 51/295 |
| 3,916,584 | 11/1975 | Howard et al. | 51/308 |
| 3,960,805 | 6/1976 | Taylor | 260/37 N |
| 4,104,243 | 8/1978 | Howard, Jr. | 260/42.14 |
| 4,311,489 | 1/1982 | Kressner | 51/298 |
| 4,427,823 | 1/1984 | Inagaki et al. | 524/833 |
| 4,588,419 | 5/1986 | Caul et al. | 51/295 |
| 4,652,274 | 3/1987 | Boettcher et al. | 51/298 |
| 4,652,275 | 3/1987 | Bloecher et al. | 51/298 |
| 4,751,138 | 6/1988 | Tumey et al. | 428/323 |
| 4,772,660 | 9/1988 | Kitamura et al. | 524/786 |
| 4,773,920 | 9/1988 | Chasman et al. | 51/295 |
| 4,799,939 | 1/1989 | Bloecher et al. | 51/293 |
| 4,871,376 | 10/1989 | DeWald | 51/298 |
| 4,885,332 | 12/1989 | Bilkadi | 524/714 |
| 4,903,440 | 2/1990 | Larson et al. | 51/298 |
| 4,927,431 | 5/1990 | Buchanan et al. | 51/298 |
| 5,009,675 | 4/1991 | Kunz et al. | 51/295 |
| 5,011,513 | 4/1991 | Zador et al. | 51/295 |
| 5,014,468 | 5/1991 | Ravipati et al. | 51/295 |
| 5,104,929 | 4/1992 | Bilkadi | 524/847 |
| 5,107,626 | 4/1992 | Mucci | 51/281 |
| 5,152,917 | 10/1992 | Pieper et al. | 51/295 |

FOREIGN PATENT DOCUMENTS

| | | | |
|---|---|---|---|
| 0475592A2 | 3/1992 | European Pat. Off. . | |
| 5-293766 | 11/1993 | Japan | B24D 11/00 |

*Primary Examiner*—Mark L. Bell
*Assistant Examiner*—Deborah Jones
*Attorney, Agent, or Firm*—Gary L. Griswold; Walter N. Kirn; David L. Weinstein

[57] ABSTRACT

Abrasive articles comprising a plurality of abrasive grits and a cured ceramer. The cured ceramer is formed from a liquid dispersion comprising a dispersing liquid and non-aggregated colloidal metal oxide particles dispersed in the dispersing liquid, wherein the dispersing liquid comprises a free-radically polymerizable composition.

34 Claims, 1 Drawing Sheet

ABRASIVE ARTICLE

FIELD OF THE INVENTION

This invention relates to an abrasive article, more particularly, an abrasive article comprising a composite binder.

BACKGROUND OF THE INVENTION

Abrasive articles typically comprise a plurality of abrasive particles and a binder. There are a number of different types of abrasive articles on the market. These include: (1) coated abrasive articles, in which the binder bonds the abrasive particles to a backing material (e.g., "sandpaper"); (2) lapping coated abrasive articles, in which the abrasive particles are dispersed in a binder to form an abrasive composite, which is then bonded to a backing to form an abrasive article; (3) bonded abrasive articles, in which the binder bonds the particles together to form a shaped mass, e.g., a grinding wheel; and (4) nonwoven abrasive articles, in which the binder bonds the abrasive particles into a nonwoven fibrous substrate. In all of these abrasive articles, there is an abrasive surface which contacts a workpiece to be abraded.

The binder in the abrasive article is typically formed by curing a liquid binder precursor. The liquid binder precursor includes a resin or an adhesive. During the manufacture of the abrasive article, the liquid binder precursor is exposed to an energy source, which ultimately results in the polymerization or crosslinking of the resin or polymer to form the solid binder. The energy source can provide thermal energy, or radiation energy, e.g., electron beam, ultraviolet light, or visible light.

In general, as the hardness of the abrasive particles and/or the binder increases, there is a corresponding increase in the cut rate, i.e. the rate at which the abrasive article is able to remove material from a workpiece. However, as the cut rate is increased by increasing the hardness of the abrasive particles and/or the binder, the quality of surface finish imparted by the abrasive article to the workpiece may be adversely affected. If the surface finish obtained is undesirably coarse, the hardness of the abrasive particles and/or of the binder may have to be reduced, thereby decreasing the advantageous cut rate.

SUMMARY OF THE INVENTION

The invention provides abrasive articles which provide a high cut rate while also imparting an excellent surface finish to the workpiece being abraded. In one embodiment, the abrasive article of this invention comprises a plurality of abrasive particles dispersed in a cured ceramer. "Ceramer" is a coined term used to identify a curable material containing at least one component that is a precursor of a ceramic and at least one component that is a precursor of a polymer. The cured ceramer is formed from a liquid dispersion comprising a dispersing liquid and non-aggregated colloidal metal oxide particles dispersed in the dispersing liquid, wherein the dispersing liquid comprises a free-radically polymerizable composition.

The cured ceramer of the invention is suitable for use in many types of abrasive articles, including bonded abrasive articles, lapping coated abrasive articles, and non-woven abrasive articles. Further, the dispersion from which the ceramer is derived may be used to prepare any or all of the coating layers utilized in these abrasive articles, e.g., make coats, size coats, and the like.

DETAILED DESCRIPTION

Figure 2:
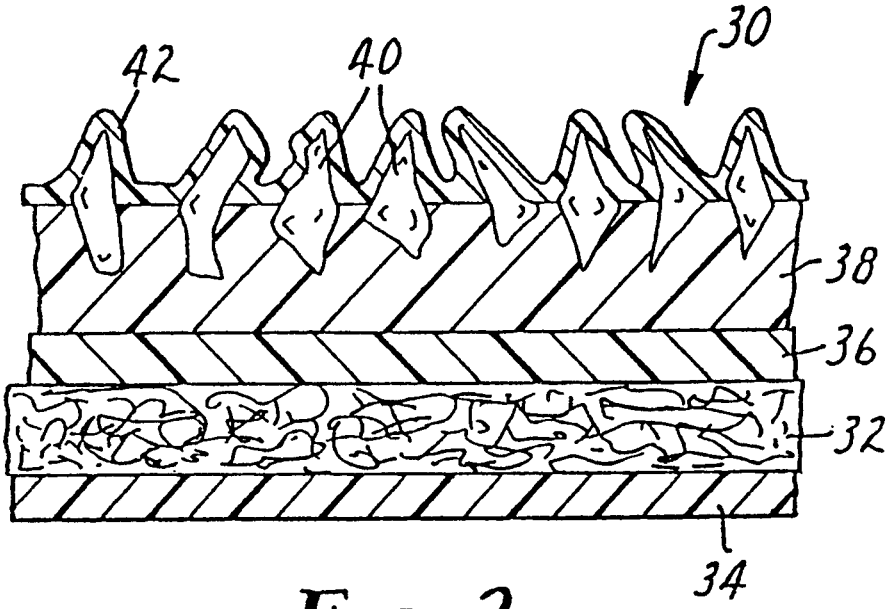
FIG. 2 illustrates in cross-section of a coated abrasive on a paper backing material.

The term "sol", as used herein, refers to a collection of non-aggregated colloidal particles dispersed in a liquid medium.

The term "colloidal metal oxide particle", as used herein, refers to a metal oxide particle, preferably spherical in shape, and having an average maximum dimension of less than 0.1 micrometer.

The term "ceramer", as used herein, refers to a composition comprising non-aggregated colloidal metal oxide particles dispersed in a free-radically polymerizable composition.

The term "exposed abrasive surface", as used herein, refers to the surface of an abrasive article that directly contacts a workpiece to be abraded.

The term "cured", as used herein, refers to the polymerization of the free-radically curable portion of the ceramer to the point at which the ceramer is transformed into a solid, non-flowing composition, hereinafter referred to as a "binder".

The abrasive article of the invention comprises a plurality of abrasive grits and a binder comprising a cured ceramer. The cured ceramer is formed by polymerizing the polymerizable component or components of a ceramer. The ceramer is preferably substantially free of water. More preferably, the ceramer contains less than 5% by weight water, most preferably less than 1% by weight water.

Colloidal metal oxide particles suitable for use in the invention are non-aggregated metal oxide particles dispersed as sols and having an average particle diameter of from about 5 to about 1000 nanometers, preferably from about 10 to about 100 nanometers, and more preferably from about 10 to about 50 nanometers. These size ranges are preferred on the basis of both ease of dispersing the metal oxide particles in the free-radically polymerizable composition and the surface finish that will be generated by the abrasive article derived therefrom.

The metal oxide sol particles may be formed of any metal oxide, in any oxidation state. Examples of preferred metal oxides include silica, alumina, zirconia, vanadia, titania, with silica being most preferred. In general, silicon is considered to be a non-metal. However, for the purposes of this invention, silicon is considered to be a metal.

The colloidal metal oxide particles useful in preparing ceramers for use in this invention must be provided as a sol rather than as a powder or a gel. In the sol state, the colloidal metal oxide particles are dispersed in a liquid medium. Representative examples of liquid media suitable as dispersants for the colloidal metal oxide particles include water, aqueous alcohol solutions, lower aliphatic alcohols, toluene, ethylene glycol, dimethyl acetamide, formamide, and combinations thereof. The preferred liquid medium is water. When the colloidal metal oxide particles are dispersed in water, the particles are stabilized on account of common electrical charges on the surface of each particle, which tends to promote dispersion rather than agglomeration. The like charged particles repel one another, thereby preventing aggregation. By contrast, in the powder state, such as in fumed silica or silica gel, uncharged colloidal particles will agglomerate to form networks and thus will not provide a uniform dispersion of particles when combined with the organic component of the ceramer. Ceramers are easily distinguished from other materials that comprise a free-radically polymerizable composition but are filled with agglomerated colloidal metal oxide particles. When the colloidal metal oxide particles in a ceramer are derived from a sol, the ceramer can remain a free-flowing liquid even at loadings of colloidal metal oxide particles exceeding 50% by weight. On the other hand, when the colloidal metal oxide particles derived from a sol are replaced with the same weight fraction of agglomerated colloidal metal oxide particles, wetted powders result.

Among the ceramers, those having non-aggregated metal oxide particles functionalized with coupling agents have processing advantages over ceramers having non-aggregated metal oxide particles not functionalized with coupling agents. The ceramers having colloidal metal oxide particles functionalized with coupling agents can be filled with more abrasive grits than those ceramers having non-functionalized colloidal metal oxide particles and still provide coatable or processable mixtures. The degree of functionalization of the colloidal metal oxide particles required to allow mixtures comprising ceramer and abrasive grits to remain coatable depends to a large extent on the concentration of colloidal metal oxide particles, the nature of the free-radically polymerizable composition, and the type of coupling agent. In general, the concentration of colloidal metal oxide particles in the ceramer can be as high as 70% by weight, with the preferred concentration ranging from about 15% to about 60% by weight.

Sols useful for preparing ceramers can be prepared by methods well known in the art. Colloidal silicas dispersed as sols in aqueous solutions are also available commercially under such trade names as "LUDOX" (E.I. dupont de Nemours and Co., Inc. Wilmington, Del.), "NYACOL" (Nyacol Co., Ashland, Mass.), and "NALCO" (Nalco Chemical Co., Oak Brook, Ill.). Non-aqueous silica sols (also called silica organosols) are also commercially available under such trade names as "NALCO 1057" (a silica sol in 2-propoxyethanol, Nalco Chemical Co , Oak Brook, Ill.), and "MA-ST", "IP-ST", and "EG-ST", (Nissan Chemical Industries, Tokyo, Japan). Sols of other oxides are also commercially available, e.g., "NALCO ISJ-614" and "NALCO ISJ-613" alumina sols, and "NYACOL 10/50" zirconia sol.

Coupling agents may be mixed with the metal oxide sol to enhance the dispersibility of the metal oxide particles in the free-radically polymerizable composition. The preferred coupling agents are hydrolyzable silane compounds. Examples of silane coupling agents suitable for this invention include acryloxyalkyl trimethoxysilane, methacryloxyalkyl trimethoxysilane, phenyl trichlorosilane, phenyltrimethoxysilane, phenyl triethoxysilane, vinyltrimethoxysilane, vinyl triethoxysilane, methyltrimethoxysilane, methyl triethoxysilane, propyltrimethoxysilane, propyl triethoxysilane, and mixtures thereof.

The free-radically polymerizable composition of the ceramer is substantially free of water. The preferred free-radically polymerizable composition comprises ethylenically unsaturated monomers. Particularly preferred monomers have the formula:

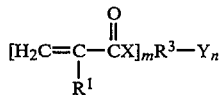

wherein $R^1$ represents a member selected from the group consisting of hydrogen, halogen, and lower alkyl group, preferably having one to four carbon atoms, more preferably hydrogen or methyl; X represents a member selected from the group consisting of oxygen and $—NR^2$, wherein $R^2$ represents hydrogen or lower alkyl group, preferably having one to four carbon atoms; $R^3$ represents a polyvalent organic group having a molecular weight of 14 to 1000 and a valence of m+n; m represents an integer designating the number of acrylic or methacrylic groups or both in the ester or amide, preferably from 1 to 9, more preferably from 2 to 5, and where a mixture of acrylic or methacrylic compounds is used, preferably having an average value of 1.05 to 5; n represents an integer having a value of 1 to 5; and Y represents a member selected from the group consisting of hydrogen, lower alkyl groups and protic functional groups, preferably selected from the group consisting of —OH, —COOH, $—CONHR^2$, $—COONH_4$, —SH, —NHR, $—NHCOOR^4$, $—SO_3H$, $—SO_4NH_4$, $—PO(ON)_2$, $—PO(ONH_4)$, and oxazolidone, in which $R^4$ represents hydrogen or a lower alkyl group, preferably having 1 to 3 carbon atoms. The polyvalent organic group $R^3$ can be cyclic or linear, aliphatic, aromatic, or heterocyclic, and which includes carbon, hydrogen, and oxygen atoms and, optionally, nitrogen atoms.

Examples of monoethylenically unsaturated monomers preferred for use in the composition of this invention include acrylic and methacrylic acid, the methyl, ethyl, and propyl esters of acrylic acid or methacrylic acid, such as methyl methacrylate, and monoethylenically unsaturated amides, such as acrylamide, methacrylamide, N,N-dimethyl acrylamide, and the like.

Examples of polyethylenically unsaturated monomers preferred for use in the composition of this invention include acrylic acid and methacrylic acid esters of polyhydric alcohols. Other polyethylenically unsaturated monomers that can be used in the composition of the invention are diallyl phthalate, 1,4(dicrotonyloxy)-butane, acrylates, and methacrylates. Other ethylenically unsaturated monomers include monoallyl, polyallyl, and polymethallyl esters and amides of carboxylic acids, tris(2-acryloxyethyl) isocyanurate, and 1,3,5-tris(2-methylacryloxyethyl)triazine.

Examples of resins that are capable of being polymerized by a free radical mechanism include acrylated urethanes, acrylated epoxies, aminoplast derivatives having pendant unsaturated carbonyl groups, isocyanurate derivatives having at least one pendant acrylate group, isocyanate derivatives having at least one pendant acrylate group, epoxy resins other than acrylated epoxies, ethylenically unsaturated compounds other than acrylated urethanes, acrylated epoxies, acrylated isocyanates, or acrylated isocyanurates, and mixtures and combinations thereof. The term "acrylate", as used herein, encompasses acrylates and methacrylates.

The liquid free-radically polymerizable composition can also be a polyethylenically unsaturated oligomer, such as an acrylated urethane or an acrylated epoxy. Acrylated urethanes are diacrylate esters of hydroxy terminated isocyanate extended polyesters or polyethers. Examples of commercially available acrylated urethanes include "UVITHANE 782", available from Morton Chemical, and "CMD 6600", "CMD 8400", and "CMD 8805", available from UCB Radcure Specialties. Acrylated epoxies are diacrylate esters of epoxy resins, such as the diacrylate esters of bisphenol A epoxy resin. Examples of commercially available acrylated epoxies include "CMD 3500", "CMD 3600", and "CMD 3700", available from UCB Radcure Specialties The aminoplast resins have at least one pendant alpha, beta-unsaturated carbonyl group per molecule or oligomer. These materials are further described in U.S. Pat. Nos. 4,903,440 and 5,236,472, both of which are incorporated herein by reference.

Isocyanurate derivatives having at least one pendant acrylate group and isocyanate derivatives having at least one pendant acrylate group are further described in U.S. Pat. No. 4,652,274, incorporated herein by reference. The preferred isocyanurate material is a triacrylate of tris(hydroxy ethyl) isocyanurate.

Ethylenically unsaturated resins include both monomeric and polymeric compounds that contain atoms of carbon, hydrogen and oxygen, and optionally, nitrogen and the halogens. Oxygen or nitrogen atoms or both are generally present in ether, ester, urethane, amide, and urea groups. Ethylenically unsaturated compounds preferably have a molecular weight of less than about 4,000 and are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of ethylenically unsaturated resins include methyl methacrylate, ethyl methacrylate, styrene, divinylbenzene, vinyl toluene, ethylene glycol diacrylate, ethylene glycol dimethacrylate, hexanediol diacrylate, triethylene glycol diacrylate, trimethylolpropane triacrylate, glycerol triacrylate, pentaerthyitol triacrylate, pentaerythritol trimethacrylate, pentaerythritol tetraacrylate and pentaerythritol tetramethacrylate. Other ethylenically unsaturated resins include monoallyl, polyallyl, and polymethallyl esters and amides of carboxylic acids, such as diallyl phthalate, diallyl adipate, and N,N-diallyladipamide. Still other nitrogen containing compounds include tris(2-acryloxyethyl)isocyanurate, 1,3,5-tri(2-methyacryloxyethyl)-s-triazine, acrylamide, methylacrylamide, N-methylacrylamide, N,N-dimethylacrylamide, N-vinylpyrrolidone, and N-vinylpiperidone.

During the manufacture of the abrasive article, the ceramer is exposed to an energy source to initiate polymerization thereof. As the ceramer is cured (i.e., polymerized), it is converted into a solid, non-flowing binder. The energy source can be a source of thermal energy or radiation energy, such as electron beam, ultraviolet light, or visible light. The amount of energy required is dependent upon the chemical nature of the reactive groups in the ceramer, as well as upon the thickness and density of the ceramer coating. For thermal energy, an oven temperature of from about 50° C. to about 250° C. and a duration of from about 15 minutes to about 16 hours is sufficient. Electron beam radiation, which is also known as ionizing radiation, can be used at an energy level of about 0.1 to about 10 Mrad, preferably at an energy level of about 1 to about 10 Mrad.

Polymerization of the preferred ethylenically unsaturated monomer(s) or oligomer(s) occurs via a free-radical mechanism. If the energy source is an electron beam, the electron beam generates free-radicals which initiate polymerization. If the energy source is heat, ultraviolet light, or visible light, an initiator or curing agent may have to be present in order to generate free-radicals. Examples of initiators that generate free-radicals upon exposure to ultraviolet light or heat include, but are not limited to, organic peroxides, azo compounds, quinones, nitroso compounds, acyl halides, hydrazones, mercapto compounds, pyrylium compounds, imidazoles, chlorotriazines, benzoin, benzoin alkyl ethers, diketones, phenones, and mixtures thereof. Examples of initiators that generate free-radicals upon exposure to visible light can be found in U.S. Pat. No. 4,735,632, incorporated herein by reference. Typically, the initiator is used in amounts ranging from 0.1 to 10%, preferably 2 to 4% by weight, based on the weight of the ceramer. Another photoinitiator that generates free-radicals upon exposure to visible light has the trade name "IRGACURE 369", commercially available from Ciba Geigy Company.

Optionally, the curable compositions may contain photosensitizers or photoinitiator systems which affect polymerization either in air or in an inert atmosphere, such as nitrogen. These photosensitizers or photoinitiator systems include compounds having carbonyl groups or tertiary amino groups and mixtures thereof. Among the preferred compounds having carbonyl groups are benzophenone, acetophenone, benzil, benzaldehyde, o-chlorobenzaldehyde, xanthone, thioxanthone, 9,10-anthraquinone, and other aromatic ketones which can act as photosensitizers. Among the preferred tertiary amines are methyldiethanolamine, ethyldiethanolamine, triethanolamine, phenylmethylethanolamine, and dimethylaminoethylbenzoate. In general, the amount of photosensitizer or photoinitiator system may vary from about 0.01 to 10% by weight, more preferably from 0.25 to 4.0% by weight, based on the weight of the ceramer. When the amount is less than 0.01% by weight, the polymerization rate may be extremely low. If the photosensitizer or photoinitiator system is used in excess of 5% by weight, no correspondingly improved effect would be expected.

The general method of making the ceramer comprises the steps of:

(a) providing a metal oxide sol in an inert liquid, such as water, (b) dispersing into said metal oxide sol a free-radically polymerizable liquid composition, and (c) removing a sufficient amount of the inert liquid, preferably by distillation, so that the resulting ceramer is substantially free of inert liquid.

Optionally a sufficient amount of a surface modifying agent (coupling agent) can be added to the ceramer to improve dispersibility thereof of the metal oxide particles.

Abrasive articles of this invention include abrasive grits, e.g., abrasive grits having an average particle size of at least about 0.1 micrometer. Addition of abrasive particles having larger sizes can increase the rate of cut.

Preferred abrasive particles have an average particle size between about 1 to 1300 micrometers, and a Mohs' hardness of at least about 8, more preferably greater than 9. Examples of suitable materials for abrasive particles include fused aluminum oxide, ceramic aluminum oxide, heat treated aluminum oxide, silicon carbide, alumina zirconia, diamond, ceria, cubic boron nitride, garnet, and combinations thereof. The term "abrasive particles" also encompasses a plurality of individual abrasive particles bonded together to from an agglomerate. Agglomerates are further described in U.S. Pat. Nos. 4,311,489; 4,652,275; and 4,799,939, incorporated herein after by reference.

The ceramer of the invention may be used in coated abrasive articles, bonded abrasive articles, lapping coated abrasive articles, and nonwoven abrasive articles.

Abrasive articles containing the ceramer can further comprise optional additives, such as fillers (including grinding aids), fibers, lubricants, antistatic agents, wetting agents, surfactants, pigments, dyes, coupling agents, plasticizers, and suspending agents, as is well known in the art.

Figure 1:
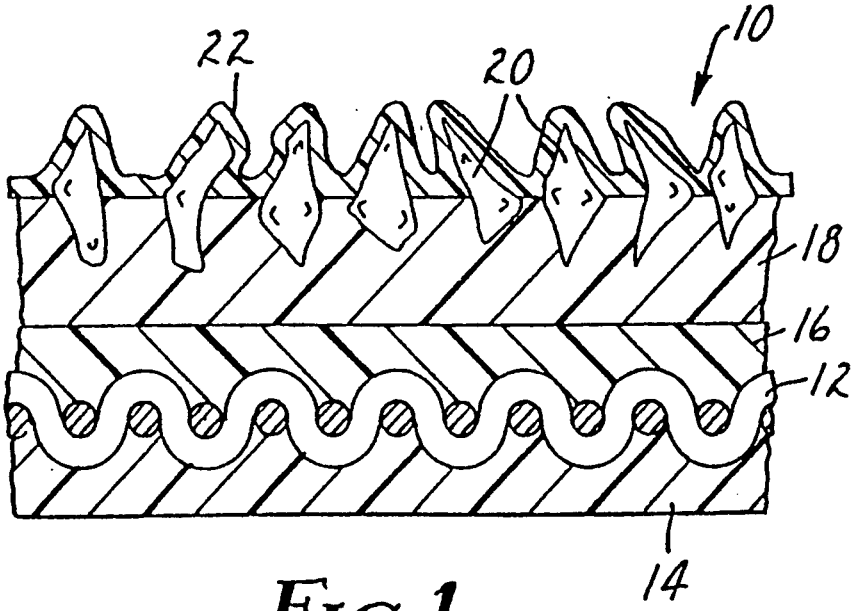
FIG. 1 illustrates in cross-section of a coated abrasive on a cloth backing material.

Coated abrasives that may be produced with the ceramers described herein are illustrated in FIGS. 1 and 2. As illustrated in FIG. 1, the coated abrasive generally indicated as 10 is cloth backed. Cloth 12 has been treated with an optional backsize coat 14 and an optional presize coat 16. Overlaying the presize coat is a make coat 18 in which are embedded abrasive particles 20 such as silicon carbide or aluminum oxide. A size coat 22 has been placed over the make coat 18 and the abrasive particles 20. There is no clear line of demarcation between the backsize coat and the presize coat which meet in the interior of the cloth backing which is saturated as much as possible with the resins of these coats.

In FIG. 2 there is illustrated a coated abrasive generally indicated as 30 which is formed on a paper backing 32. Paper backing is treated with a backsize coat 34 and presize coat 36. The presize coat is overcoated with a make coat 38 in which are embedded abrasive particles 40. The abrasive particles 40 and make coat 38 are overcoated with a size coat 42 which aids in holding the abrasive particle 40 onto the backing during utilization and further may contain cutting aids.

Suitable backings for coated abrasive articles or lapping coated abrasive articles include polymeric film, primed polymeric film, cloth, paper, vulcanized fiber, nonwoven substrates, treated nonwoven substrates, and combinations thereof. The cloth or nonwoven substrate is preferably formed from glass, polyester, polyamide, rayon, cotton, or combinations thereof. Suitable materials for polymeric films include polyester, polyamide, polyethylene, and polypropylene.

The ceramer can be used to form one or more of the coatings that are conventionally used in forming coated abrasive articles or lapping coated abrasive articles. For example, the ceramer can be used as the make coat, i.e., the adhesive coat that secures the abrasive particles to the backing, the size coat, i.e., the adhesive coat overlying the abrasive particles that reinforces the abrasive particles, the supersize coat, i.e., the coat overlying the size coat, or as a backing treatment or coat, e.g., as a saturant coat that saturates the backing material or as a surface coat that is present on the back side of the backing, opposite the abrasive particles. The ceramer need not be used for all of the coating layers. Conventional binders can be used for one or more of the coating layers. The precise ratio of colloidal metal oxide particles to organic material in a coating of a coated abrasive article is a matter of choice. The coating should contain a sufficient amount of colloidal metal oxide particles to obtain whatever effect is desired. A concentration of colloidal metal oxide of as low as about 15% by weight of the binder has been shown to be useful, and it is believed that concentrations of colloidal metal oxide below 15% by weight of the binder, e.g. 5% to 15%, would also show some usefulness. However, the amount of colloidal metal oxide particles must not be so high that adverse effects are encountered. Such adverse effects include difficulty in coatability, severely decreased cut, and excessively uneven finish.

In a bonded abrasive article, the cured ceramer bonds the abrasive particles into a shaped mass, e.g., a wheel. In a preferred manufacturing method, the ceramer is mixed with the abrasive particles and the resulting mixture is charged to a mold. The mold is then heated, under pressure if desired, to cure the ceramer. Finally, the bonded abrasive article is removed from the mold.

A preferred method for preparing a coated abrasive article involved the following steps. First, a saturant coat precursor is applied to the backing by any conventional technique, such as dip coating or roll coating. After the saturant coat is applied, backsize or presize coat precursors can be applied by any conventional technique, such as roll coating, die coating, or knife coating. The make coat precursor is applied over the optional presize coat by any conventional technique, such as spray coating, roll coating, die coating, or knife coating. The abrasive particles are projected into the make coat precursor, before the make coat precursor is dried or partially cured. Typically, the abrasive particles are then preferably projected by an electrostatic coating process. Then, the size coat precursor is applied over the abrasive particles by any conventional technique. Finally, the supersize coat precursor is applied over the size coat by any conventional technique.

The precursors of the saturant coat, backsize coat, presize coat, make coat, size coat, and supersize coat are at least either sufficiently dried or partially cured such that the coat is dry to the touch before the application of the subsequent coat. Each of these coats is preferably at least partially cured and may be substantially completely cured before the next coat is applied. If necessary, after the last coat is applied, the other partially cured coats are subjected to further cure. The various coats should be sufficiently polymerized or hardened so as to be useful in grinding operations.

A preferred method for preparing a lapping coated abrasive article involves the following steps. First, the ceramer is mixed with abrasive particles to form a mixture hereinafter referred to as an abrasive slurry. It is generally preferred that the abrasive particles be uniformly dispersed throughout the ceramer. After the abrasive slurry is prepared, it is applied to the front side of a backing by any conventional means such as spray coating, roll coating, die coating, or knife coating. Next, the abrasive slurry is exposed to an energy source to cure, i.e., polymerize, the ceramer.

Other methods for making a lapping coated abrasive article are described in U.S. Pat. No. 5,152,917 and U.S. Ser. No. 08/004,929, filed Jan. 14, 1993, both of which are incorporated herein by reference. According to one embodiment of these methods, the abrasive slurry is first introduced into the cavities of a production tool and then a backing is brought into contact with the production tool such that the abrasive slurry wets one surface of the backing. While the abrasive slurry is present in the cavities, it is exposed to an energy source to cure the binder precursor. This curing results in the binder precursor being converted into a rigid binder and forming an abrasive article. In another embodiment, the abrasive slurry is coated onto the surface of a backing which is then brought into contact with the production tool such that the slurry penetrates into the cavities. The remaining steps are the same as in the first embodiment. It is preferred to cure the binder precursor by exposure to radiation energy, most preferably ultraviolet or visible light. If the backing is transparent, the ultraviolet or visible light can penetrate through the backing and into the abrasive slurry. If the production tool is transparent, ultraviolet or visible light can be transmitted through the production tool.

A lapping coated abrasive article prepared by the process described above will have a patterned surface. This patterned surface comprises precisely shaped abrasive composites bonded to the backing. Each precisely shaped abrasive composite comprises a plurality of abrasive grits and a binder. Each precisely shaped abrasive composite has a distinct and discernible planar boundary.

The abrasive articles of the invention are intended to be used to abrade the surface of a workpiece. The coated, lapping, and nonwoven abrasive articles can be converted into sheets, belts, discs, rolls, cones, or other desired shapes. The workpiece can be made of any solid material, e.g., metal and metal alloys, glass, plastic, painted surfaces, ceramics, wood, wood-like materials, and inorganic materials, such as marble and stone. The surface that is to be abraded can be relatively flat or contoured. Techniques for using abrasive articles are well known in the art.

The following non-limiting examples will further illustrate the invention. All parts, percentages, ratios, etc, in the examples are by weight unless indicated otherwise. The following abbreviations and trade names are used throughout:

| | |
|---|---|
| MTMS | methyl trimethoxysilane |
| NVP | N-vinyl pyrrolidone |
| CSP1 | an aqueous dispersion (34% solids) of colloidal silica particles, commercially available from Nalco Chemical Co. under the trade designation "1034A" |
| CSP2 | an aqueous dispersion (40% solids) of colloidal silica particles, commercially available from Nalco Chemical Co. under the trade designation "2327A" |
| TMSPMA | 3-(trimethoxysilyl)propyl methacrylate, commercially available from Dow Corning under the trade designation "Z6030". |
| TATHEIC | triacrylate of tris(hydroxyethyl) isocyanurate |
| PH1 | 2,2-dimethoxy-2-phenylacetophenone, commercially available from Ciba Geigy Company under the trade designation "IRGACURE 651" |
| TMPTA | trimethylol propane triacrylate |
| F#X | brown fused aluminum oxide abrasive grits, available from Treibacher |
| ALFSX | heat-treated brown fused aluminum oxide abrasive grits, available from Treibacher |
| PH2 | 2-benzyl-2-(dimethylamino)-1-{4-4-morpholinyl)phenyl}-1-butanone, commercially available from Ciba Geigy Company under the trade designation "IRGACURE 369" |
| EMAB | ethyl dimethyl aminobenzoate |
| ASP | amorphous silica particles, having an average surface area of 50 $m^2$/gram, commercially available from Degussa Corp, Ridgefield Park, NJ, under the trade designation "OX-50" |

-continued

| | |
|---|---|
| WAO | white fused aluminum oxide abrasive grits |

The following preparations (I–XIV) describe how the ceramers used in the examples were prepared.

PREPARATION I

The following materials were charged into a 22 liter round-bottom flask: CSP1 (6000 g), hydroxyethylmethacrylate (HEMA) (1000 g), and TMSPMA (504 g). The flask was then placed on a Bucchi R152 rotary evaporator with the bath temperature set at 55° C. A refrigerated mixture of 50% deionized water/50% antifreeze (Texaco) recirculated through the cooling coils. Volatile components were removed at a reduced pressure of approximately 25 Torr until the distillation rate was reduced to less than 5 drops per minute (approximately 3 hours). The resulting material was designated CER1.

PREPARATION II

Preparation I was repeated with the exception that hydroxyethylacrylate (HEA) was used in place of hydroxyethylmethacrylate. The resulting material was designated CER2.

PREPARATION III

The following materials were charged into a 22 liter round-bottom flask: CSP2 (5080 g), N,N-dimethylacrylamide (NNDMA) (2040 g), TMSPMA (504 g) and isopropyl alcohol (IPA) (2000 g). The flask was then placed on a Bucchi R152 rotary evaporator with the bath temperature set at 55° C. A refrigerated mixture of 50% deionized water/50% antifreeze (Texaco) recirculated through the cooling coils. Volatile components were removed at a reduced pressure of approximately 125 Torr until the distillation rate was reduced to less than 5 drops per minute (approximately 3 hours). A milky mixture was formed. To the mixture was added isopropyl alcohol (2000 g). When distillation at this pressure ceased, the pressure was reduced to 25 Torr. The stripping process continued until the reaction products changed in color from whitish to transparent and clear. The resulting material was designated CER3.

PREPARATION IV

To a one liter round-bottom flask were added the following materials: CSP1 (150 g), reagent grade isopropyl alcohol (150 g), TMSPMA (12.6 g), and glycerol dimethacrylate (119 g). The flask was attached to a Bucchi R152 rotary evaporator, and all volatile components were removed under vacuum at a temperature range of 50° to 60° C. to form a clear gel. The gel was redispersed twice in isopropyl alcohol (60 g), then the alcohol removed under vacuum at a temperature of 55° C. After the second alcohol removal, the residue of crystal clear ceramer with a greenish tint remained. The silica content was 30% by weight, and the resulting material was designated CER4.

PREPARATION V

To a 10 liter flask were added the following materials: CSP2 (625 g) and NVP (250 g). The water was removed by means of a rotary evaporator at a temperature of 55° C. and a pressure of 0.9 Torr. The dehydrated, clear liquid weighed 519 g. To the dehydrated, clear liquid was added CSP2 (625 g) and NVP (250 g), and the dehydration step repeated to obtain 987 g of dehydrated, clear ceramer comprising 50% by weight dispersed silica particles and 50% by weight NVP. This ceramer was designated CER5.

PREPARATION VI

In a 10 liter flask were added the following materials: CSP2 (1275 g) and NNDMA (510 g). The mixture was stripped of water by means of a rotary evaporator at a temperature of 55° C. and a pressure of 100 Torr. After about 300 g of water were removed, about 1000 g of reagent grade isopropyl alcohol were added to the mixture, which was concentrated to a weight of 1013.2 g. Then NNDMA (6.8 g) was added to adjust the total weight of the mixture to 1020 g. The resulting clear liquid ceramer was designated CER6.

PREPARATION VII

Preparation V was repeated, with the exception that CSP2 (1470.6 g) and HEA (500 g) was concentrated at a temperature of 55° C. and a pressure of 0.9 Torr to a weight of 1003 g. The resulting clear liquid ceramer was designated CER7.

PREPARATION VIII

Into a 10 liter flask were introduced the following ingredients: CSP2 (1000 g), NNDMA (400 g), and TMSPMA (49.6 g). The mixture was placed on a Bucchi R152 rotary evaporator attached to a vacuum pump, and the volatiles removed at a bath temperature of 55° C. and a pressure of about 75 Torr, with the head temperature rising from 26° C. to 30° C. After the evaporation was complete, the flask and its contents were weighed and NNDMA (18.6 g) was added to adjust the total residual weight to 849.6 g (which is the expected theoretical weight of the residual ceramer). The resulting clear liquid ceramer was designated CER8. It was similar to CER3, except that it had only 50% as much TMSPA per unit weight CSP2 as did CER3.

PREPARATION IX

In a procedure similar to that for Preparation VIII, CSP2 (1000 g), NNDMA (400 g), and TMSPMA (24.8 g) were processed to produce 822 g of a clear liquid ceramer, which was designated as CER9. CER9 was similar to CER3, except that it contained 25% as much TMSPMA per unit weight CSP2 as did CER3.

PREPARATION X

In a procedure similar to that for Preparation VIII, CSP2 (1000 g), NNDMA (400 g), TMSPMA (248 g) and MTMS (13.6 g) were processed to provide a clear liquid ceramer, which was designated as CER10.

PREPARATION XI

In a procedure similar to that for Preparation VIII, CSP2 (1000 g), NNDMA (400 g), and MTMS (54.5 g) were processed to provide a clear liquid ceramer, which was designated CER11.

PREPARATION XII

In a 10 liter flask was dissolved TATHEIC (400 g) (Sartomer Co., West Chester, Pa.) in NNDMA (400 g) (Jarchem Ind., Newark, N.J.). To this solution was added TMSPMA (200 g) and CSP2 (2015 g). The flask was then attached to a R-152 rotary evaporator (Brinkmann Inst. Inc. Westbury, N.Y.), and the water removed at a temperature of 55° C. under a pressure of 0.9 Torr. The resulting clear liquid ceramer was designated CER12.

PREPARATION XIII

In a 10 liter flask were introduced TMPTA (408 g), NNDMA (408 g), TMSPMA (200 g), and CSP2 (2030 g). The flask was then attached to a R-152 rotary evaporator, and the water removed at a temperature of 55° C. under vacuum. The resulting dehydrated clear liquid ceramer was designated CER13.

PREPARATION XIV

In a 10 liter flask were introduced pentaerythritol triacrylate (PETA) (408 g) (Sartomer Co.), NNDMA (408 g), TMSPMA (200 g), and CSP2 (2032 g). The flask was then attached to a R-152 rotary evaporator, and the water removed at a temperature of 55° C. under vacuum. The resulting clear liquid ceramer was designated CER14.

PREPARATION XV

In a 10 liter flask were introduced pentaerythritol triacrylate (PETA) (1079 g), TMSPMA (100 g), HEA (403 g) and CSP2 (2015 g). The flask was then attached to a R-152 rotary evaporator and the water removed at a temperature of 55° C. under vacuum. The resulting clear liquid was designated CER15.

General Procedure I for Making a Coated Abrasive Article

The make coat was applied onto a backing by means of a die coater. Immediately after the coating step, abrasive grits were electrostatically projected into the make coat. The resulting construction was exposed at a rate of 4.5 meters/minute to a Fusion Systems ultraviolet lamp containing a "D" bulb that operated at 300 Watts/inch (118 Watts/cm). Next, a size coat was applied by means of a roll coater. Then, the size coat was exposed at a rate of 6.1 meters/minute to two ultraviolet lamps containing a "D" bulb that operated at 300 Watts/inch.

General Procedure II for Making a Coated Abrasive Article

The procedure in U.S. Pat. No. 5,152,917, incorporated herein by reference, was used. A mixture comprising precursor for preparing a binder and abrasive grits was coated onto an opaque production tool having pyramidal-shaped recesses such that the mixture filled the recesses in the tool. The bases of the pyramids were butted up against one another and each base had approximate dimensions of 360 micrometers (two sides) and 400 micrometers (one side). The approximate depth of the pyramidal-shaped recess was 180 micrometers.

Next, a substrate made of polyester film (130 micrometers thick) was pressed against the production tool by means of a roller, whereby the mixture wetted the front surface of the polyester film. The front surface of the polyester film had been coated with an ethylene acrylic acid primer. Then ultraviolet light was transmitted through the polyester film and into the mixture to initiate polymerization of the binder precursor. The ultraviolet light source comprised two 300 Watts/inch Aetek "H" bulbs, one at a high setting and the other at a medium setting. The rate of movement of the substrate was 2.7 meters/minutes. The light caused the mixture to be converted into an abrasive composite, the abrasive composite adhering to the polyester film substrate. Next, the polyester film/abrasive composite construction was separated from the production tool to form the coated abrasive article.

General Procedure III for Making a Coated Abrasive Article

This procedure was similar to that of General Procedure II for Making a Coated Abrasive Article with the following differences: (1) the production tool onto which the mixture of precursor for the binder and abrasive grits was coated was transparent to ultraviolet light, the tool being made either of polypropylene or of a polypropylene/polyethylene copolymer, (2) the backing was a 300 micrometer thick J weight rayon backing (available from Milliken Co.) precoated with a phenolic resin presize, (3) a 600 watt Fusion Systems "V" bulb was used and the web speeds varied from 9.14 to 27.4 m/min., (4) the ultraviolet light was transmitted through the transparent tool into the mixture.

Test Procedure I

The coated abrasive article was converted into an endless belt (7.6 cm by 335 cm) and tested on a constant load surface grinder. A preweighed 1018 mild steel workpiece approximately 2.5 cm by 5 cm by 18 cm was mounted in a holder. The workpiece was positioned vertically with its face (2.5 cm by 18 cm) confronting a serrated rubber contact wheel (36 cm in diameter and measuring 85 Shore hardness) which supported the abrasive belt. The workpiece was then reciprocated vertically through an 18 cm path at the rate of 20 cycles per minute, while a spring-loaded plunger urged the workpiece against the belt under a load of 4.5 Kg. The belt was driven at about 2050 meters per minute. After one minute of elapsed grinding time, the workpiece holder assembly was removed and re-weighed. The amount of stock removed was calculated by subtracting the weight after the abrading step from the original weight. A new, pre-weighed workpiece and holder were mounted on the equipment. The test endpoint was 20 minutes of grinding. Additionally, the surface finish (Ra) was measured after the initial cut of 1 minute, after 10 minutes, and after 20 minutes of grinding. Ra is the arithmetic average of the scratch size in microinches. Another measurement that was sometimes also made at the same time was the peak value, which is the largest scratch depth in microinches.

Test Procedure II

Test Procedure II was similar to Test Procedure I but with the following differences: (1) The endpoint of grinding was either when the amount of removal during the last one-minute cycle was less than one-third of the amount removed in the first cycle or the workpiece became shiny, (2) the Ra and peak readings were taken only after each of the first four cycles and the average of these readings was reported.

Test Procedure III

The coated abrasive article for each example was converted into a disc (12.7 cm diameter) and secured to a foam back-up pad by means of a pressure sensitive adhesive. The coated abrasive disc/back-up pad assembly was installed on a Schiefer testing machine, and the coated abrasive disc was used to abrade a workpiece made of cellulose acetate butyrate polymer. The load was 4.5 kg. All of the testing was done underneath a water flood at a flow rate of 60 g of water per minute. The endpoint of the test was 500 revolutions or cycles of the coated abrasive disc. The amount of cellulose acetate butyrate polymer removed and the surface finish (Ra) of the cellulose acetate butyrate polymer workpiece were measured at the end of the test. The peak was the difference in the highest to lowest points in the scratch pattern in microinches.

Test Procedure IV

Test Procedure IV was essentially the same as Test Procedure III, except that the workpiece was made of polymethylmethacrylate.

Test Procedure V

Test Procedure V was essentially the same as Test Procedure III, except that the abrading was conducted with no water flood.

Test Procedure VI

Test Procedure VI was essentially the same as Test Procedure IV, except that the abrading was conducted with no water flood.

Examples 1–4 and Comparative Examples A Through F

The coated abrasive articles of Examples 1–4 and Comparative Examples A through E were made according to General Procedure I. The method of making the coated abrasive article of Comparative Example F is described below.

The composition of the precursor of the make coat and size coat for each example is set forth in Table 1. The precursors of Examples 1, 2, 3, 4 contained two species of free-radically polymerizable monomers in a 1:1 ratio. Likewise, the precursors of Comparative Examples A, B, C, and D contained two species of free-radically polymerizable monomers in a 1:1 ratio. For example, the ceramer of CER2 in Table 1 contained 28.2% HEA, which amounted to 176 g HEA, and the remaining material of CER2 consisted of silica particles treated with the coupling agent. Therefore, 176 g of TATHEIC were used for the precursor of Example 1 to keep the weight ratio of HEA/TATHEIC equal to unity, i.e., 1:1. The composition of Comparative Example A differed from that of Example 1 only in that it lacked the silica sol component of Example 1. These coated abrasive articles were tested according to Test Procedure I and the test results are set forth in Tables 3 and 4.

TABLE 1

| | Amount (g) Example No. | | | | | | | | |
|---|---|---|---|---|---|---|---|---|---|
| Ingredient | 1 | 2 | 3 | 4 | Comp. A | Comp. B | Comp. C | Comp. D | Comp. E |
| TATHEIC | 176 | | | | 400 | | | | 400 |
| PETA | | 176 | | 176 | | 400 | | 400 | |
| TMPTA | | | 176 | | | | 400 | | 400 |
| HEA | | | | | 400 | 400 | 400 | | |
| HEMA | | | | | | | | 400 | |
| CER1* | | | | 624 | | | | | |
| CER2** | 624 | 624 | 624 | | | | | | |
| PH2 | 8 | 8 | 8 | 8 | 8 | 8 | 8 | 8 | 8 |

TABLE 1-continued

| Ingredient | Amount (g) Example No. 1 | 2 | 3 | 4 | Comp. A | Comp. B | Comp. C | Comp. D | Comp. E |
|---|---|---|---|---|---|---|---|---|---|
| EMAB | 12 | 12 | 12 | 12 | 12 | 12 | 12 | 12 | 12 |
| Benzophenone | 12 | 12 | 12 | 12 | 12 | 12 | 12 | 12 | 12 |
| TMSPMA | 12 | 12 | 12 | 12 | 12 | 12 | 12 | 12 | 12 |

*CER1 contains 28.2% HEMA
**CER2 contains 28.8% HEA

The precursor formulations for the make and size coats for Examples 1 through 4 were diluted to 90% solids with isopropanol and the precursor formulation for the make and size coats for Comparative Example E was diluted to 95% solids with isopropanol.

The backing for this set of examples was a polyester film (76 micrometers thick) that had been primed with an ethylene acrylic acid copolymer. The abrasive grits were of grade P120 F#X. The make coat of each example contained 35% calcium carbonate filler and 65% binder precursor. The size coat of each example contained 50% calcium carbonate filler and 50% binder precursor. The coating weights of the make coat, abrasive grit coat, and size coat in grams/square meter are set forth in Table 2. After the coated abrasive articles were made, the samples were heated for 45 minutes at a temperature of 104° C. to activate the ethylene acrylic acid copolymer primer.

TABLE 2

| Example | Weight of make coat ($g/m^2$) | Weight of abrasive grits ($g/m^2$) | Weight of size coat ($g/m^2$) |
|---|---|---|---|
| 1 | 48 | 208 | 113 |
| 2 | 50 | 202 | 106 |
| 3 | 52 | 196 | 109 |
| 4 | 56 | 194 | 96 |
| Comp. A | 37 | 193 | 121 |
| Comp. B | 45 | 201 | 114 |
| Comp. C | 45 | 197 | 108 |
| Comp. D | 43 | 198 | 100 |
| Comp. E | 44 | 214 | 134 |

Comparative Example F

To a polyester film backing (76 micrometer thick) that had been primed with an ethylene acrylic acid copolymer was applied a make coat precursor by means of a die coater. The coating solution for the make coat precursor contained 25 parts polyvinyl alcohol ("ELVANOL 51-05", E.I. DuPont de Nemours), 75 parts resole phenolic resin, and 0.65 part wetting agent ("INTERWET 33", Interstab Chemical) The coating solution for the precursor for the make coat had been diluted to 84% solids prior to coating. Into the make coat precursor was electrostatically projected grade P180 F#X abrasive grits. The resulting construction was heated for one hour at a temperature of 90° C. Then, a size coat precursor consisting of 25 parts calcium carbonate and 75 parts resole phenolic resin (74% solids in water) was applied. The resulting construction was heated for one hour at a temperature of 90° C., 10 hours at a temperature of 100° C., and 45 minutes at a temperature of 120° C.

TABLE 3

| Example | Initial cut (g) | Final cut (g) | Total cut (g) |
|---|---|---|---|
| 1 | 31.7 | 22.2 | 497.8 |
| 2 | 29.5 | 20.4 | 464.4 |
| 3 | 30.0 | 21.5 | 470.6 |
| 4 | 28.7 | 19.7 | 439.5 |
| Comp. A | 31.5 | 21.5 | 480.7 |
| Comp. B | 27.5 | 19.9 | 434.7 |
| Comp. C | 27.0 | 19.6 | 424.6 |
| Comp. D | 29.7 | 21.3 | 468.5 |
| Comp. E | 28.3 | 20.7 | 460.5 |
| Comp. F | 34.9 | 23.2 | 518.7 |

TABLE 4

| Example No. | Ra (microinches) for a given cut time (minutes) 1 minute | 10 minutes | 20 minutes |
|---|---|---|---|
| 1 | 71.0 | 54.8 | 48.3 |
| 2 | 77.7 | 56.7 | 56.2 |
| 3 | 76.2 | 65.3 | 62.4 |
| 4 | 82.5 | 53.8 | 52.8 |
| Comp. A | 79.3 | 59.7 | 58.0 |
| Comp. B | 91.0 | 64.3 | 56.3 |
| Comp. C | 86.7 | 62.8 | 52.8 |
| Comp. D | 99.5 | 64.0 | 61.0 |
| Comp. E | 85.7 | 73.2 | 61.3 |
| Comp. F | 79.0 | 62.7 | 54.0 |

Table 3 shows that the abrasive articles of Examples 1, 2, and 3 outperformed the abrasive articles of Comparative Examples A, B and C, respectively, and the abrasive articles of Examples 1, 2, and 3 outperformed the abrasive article of Comparative Example E. Table 4 shows that the surface finishes imparted by the articles of Examples 1–4 were comparable to that imparted by the articles of Comparative Examples A–F.

Examples 5–9 and Comparative Examples G Through L

The abrasive articles for this set of examples were made according to General Procedure III for Making a Coated Abrasive Article. The composition of the precursor for the binder for each example is set forth in Table 5. The values in Table 5 are in parts by weight.

TABLE 5

| Ingredient | Example No. 5 | 6 | 7 | 8 | 9 | G | H | I | J | K |
|---|---|---|---|---|---|---|---|---|---|---|
| CER1 | 78 | | | | | | | | | |
| CER2 | | 78 | | | | | | | | |
| CER3 | | | 69.2 | 69.2 | 69.2 | | | | | |
| TMPTA | 22 | 22 | | | | 50 | 50 | | 50 | 50 |
| PETA | | | 30.8 | 30.8 | 30.8 | | | 50 | | |
| TATHEIC | | | | | | | | | 50 | 50 |
| HEMA | | | | | | 50 | | | | |
| HEA | | | | | | | 50 | | | |
| NNDMA | | | | | | | | 50 | | |

To each 100 parts precursor for the binder was added one part photoinitiator PH2. The precursor for the binder and PH2 comprised 29 parts of the formulation for each example. Other constituents of each formulation included 69 parts WAO (40 micrometer), 1 part TMSPMA, and 1 part ASP, except for the formulations of Examples 7, 8, and 9, which included 2 parts ASP, and the formulations of Comparative Examples H and I, which included 3 parts ASP.

To make the formulations, all ingredients were mixed by means of a low-shear mixer for 10 minutes. The web speed during curing was 9.14 m/min, except for Example 8 and Comparative Example K, in which the web speed was 18.28 m/min. and Example 9, in which the web speed was 27.4 m/min. The abrasive article in Comparative Example L of Table 5 was 3M Grade P320 "THREE-M-ITE Resinbond Cloth", JE weight, commercially available from Minnesota Mining and Manufacturing Company. The webs were cut to form belts, which belts were heated at a temperature of 220° F. for 12 hours after they had been made. The results reported in Table 6, which were generated by Test Procedure II, represent the average of 2 belts for all samples except Comparative Example L, for which only one belt was used.

TABLE 6

| Example | Cut (g) | Ra(micro-in) | Speed(m/min) | ASP (parts) |
|---|---|---|---|---|
| 5 | 19.4 | 19.4 | 9 | 1 |
| 6 | 74.9 | 19.9 | 9 | 1 |
| 7 | 82.5 | 21.5 | 9 | 2 |
| 8 | 95.0 | 20.7 | 18 | 2 |
| 9 | 94.1 | 21.4 | 27 | 2 |
| Comp. G | — | — | — | — |
| Comp. H | 48.9 | 17.7 | 9 | 3 |
| Comp. I | 51.8 | 18.1 | 9 | 3 |
| Comp. J | 76.1 | 19.3 | 9 | 1 |
| Comp. K | 67.1 | 20.7 | 18 | 1 |
| Comp. L | 104.5 | 26.0 | — | — |

The binder precursor in Comparative Example G did not cure.

It can be seen from the data in Table 6 that the cuts for the abrasive articles of Examples 6 and 7 (which used ceramers) were superior to the cuts of the abrasive articles of Comparative Examples H and I, respectively (which did not use ceramers). The binder precursor in Example 5 was cured upon exposure to ultraviolet and visible light, while the corresponding binder precursor of Comparative Example G could not be cured under the same conditions. Examples 7, 8, and 9 show that the process speed does not adversely affect cut or finish. Additionally, the abrasive articles of Examples 7 and 8 showed a greater total cut that did the abrasive articles of corresponding Comparative Examples J and K, both of which used a radiation-curable binder. The abrasive article of Comparative Example L would have been expected to cut more than the article of any other example in this set because it contained a coarser mineral (P320 ALFSX for Comparative Example L as compared with 40 μ WAO for the other examples).

Examples 10–16 and Comparative Examples M and N

These examples show the effect of the type and amount of coupling agent used in making the ceramer on the performance of the cured ceramer/abrasive grain composite in an abrasive article. The composition of the ceramer is set forth in Table 7. The values in Table 7 are in parts by weight.

To each 100 parts of ceramer as set forth in Table 7 was added 1 part PH2. Together, the resin and PH2 constituted 29 parts of the formulation for each example. Other constituents of each formulation include 69 parts brown aluminum oxide (P320 ALFSX), 1 to 2 parts ASP, and 1 part TMSPMA. The ratio of these four constituents is set forth for each example given in Table 8. Table 8 also sets forth the cut and finish data for the articles of Examples 10–16 and Comparative Examples M and N. The abrasive articles of Examples 10–16 and Comparative Examples M were made according to the General Procedure III for Making the Coated Abrasive Article, with the web speed being 15 m/min. The abrasive article of Comparative Example N was a 3M Grade P320 "THREE-M-ITE Resinbond Cloth", JE weight The articles were tested according to Test Procedure II.

TABLE 7

| | Example | | | | | | | |
|---|---|---|---|---|---|---|---|---|
| Ingredient | 10 | 11 | 12 | 13 | 14 | 15 | 16 | Comp. M |
| CER8 | 67.9 | | | | | | | |
| CER9 | | 67.3 | 67.3 | | | | | |
| CER10 | | | | 67.7 | 67.7 | | | |
| CER11 | | | | | | 68.1 | 68.1 | |
| PETA | 32.0 | 32.6 | 32.6 | 32.3 | 32.3 | 31.9 | 31.9 | |
| TMPTA | | | | | | | | 50 |
| TATHEIC | | | | | | | | 50 |

TABLE 8

| Ex. | Cut (g) | Ra (μin) | a:b:c:d[1] | No. of belts tested |
|---|---|---|---|---|
| 10 | 90.7 | 20.9 | 69:2:29:1 | 1 |
| 11 | 103.7 | 24.8 | 69:2:29:1 | 2 |
| 12 | 101.7 | 24.4 | 70:3:29:1 | 1 |
| 13 | 107.4 | 22.8 | 69:2:29:1 | 1 |
| 14 | 101.7 | 20.5 | 70:3:29:1 | 1 |
| 15 | 104.0 | 24.4 | 69:2:29:1 | 2 |
| 16 | 100.0 | 22.0 | 70:2:29:1 | 1 |
| Comp. M | 105.5 | 24.0 | 69:1:29:1 | 2 |
| Comp. N | 83.2 | 25.6 | | 2 |

[1]a = parts by weight of P320 ALFSX.
b = parts by weight of ASP.
c = parts by weight of resin plus photoinitiator.
d = parts by weight of TMSPMA.

The data of Table 8 show that when CER8 (Example or CER9 (Examples 11, 12) is used with the coupling agent TMSPMA in the binder precursor, the performance of the abrasive article is better than that of the abrasive article of Comparative Example N. When CER10 is used along with both TMSPMA and MTMS (Examples 13, 14), or CER11 is used along with coupling agent MTMS (Examples 15, 16), as the ceramer, the performance of the abrasive article is better than that of the abrasive article of Comparative Example N and comparable to that of the abrasive article of Comparative Example M. It should be noted that the results obtained by using ceramers as precursors for binder for abrasive articles were achieved without any attempt to optimize the coatability of the formulations, and that the formulation used to prepare the abrasive article of Comparative Example M is of much better coating quality that any of the formulations used to prepare the abrasive articles of Examples 10–16.

Examples 17–24 and Comparative Examples O and P

These examples show the effect of increasing the silica concentration and decreasing the monofunctional acrylate monomer concentration (e.g. N,N-dimethylacrylamide or hydroxyethyl acrylate) on the performance of the cured ceramer/abrasive grain composite in an abrasive article.

To each 100 parts of the ceramer-containing compositions shown in Table 9 was added 1 part PH2. Together, the composition containing the PH2 amounted to 29 parts of the formulation for each example, except where noted in Table 9 (Examples 20 and 24). Other constituents of each formulation were 69 parts of P320 ALFSX brown aluminum oxide, 1 part ASP, and 1 part TMSPMA. Comparative Example 0 contained no ceramer. Comparative Example P was a 3M Grade P320 "THREE-M-ITE Resinbond Cloth", JE weight Examples 17–24 and Comparative Example 0 were made according to the General Procedure III for Making the Abrasive Article. The rate of curing was 15 m/min. The articles were tested according to Test Procedure II. The results represent the average of three belts, except where noted. The values in Table 9 are in parts by weight.

TABLE 9

| | Example No. | | | | | | | | |
|---|---|---|---|---|---|---|---|---|---|
| Ingredient | 17 | 18 | 19 | 20[1] | 21 | 22 | 23 | 24[2] | Comp. O |
| CER2 | 78 | 73.9 | | | | | | | |
| CER14 | | | 80 | 85 | 75 | | | | |
| CER13 | | | | | | 100 | | | |
| CER12 | | | | | | | | 100 | |
| CER3 | | | | | | | 100 | | |
| TATHEIC (50%)/ TMPTA (50%) | 22 | 26.1 | | | 25 | | | | 100 |
| PETA | | | 20 | | | | | | |
| TMPTA | | | | 15 | | | | | |

[1]PETA (25 g) added to reduce viscosity.
[2]PETA (10 g) added to reduce viscosity.

The data in Table 10 show that all abrasive articles containing cured ceramer outperformed the conventional P320 belt (Comparative Example P) and the articles of Examples 19–21 outperformed the article containing the standard radiation-cured system (Comparative Example 0). Additionally, the viscosities of the ceramers in all but Example 23 were high enough to provide formulations which supported the mineral without settling, which is an important processing consideration.

TABLE 10

| Ex. No. | Initial cut (g) | Total cut (g) | Ra (μin) | Peak (μin) | Belt weight (g) | Viscosity (cP) |
|---|---|---|---|---|---|---|
| 17 | 18.2 | 137.8 | 25.3 | 222.6 | 154.3 | 854 |
| 18 | 17.9 | 133.2 | 24.3 | 231.5 | 170.7 | 1188 |
| 19 | 19.6 | 172.8 | 26.5 | 256.0 | 146.4 | 1920 |
| 20 | 19.8 | 194.2 | 28.0 | 246.5 | 176.2 | — |
| 21 | 18.9 | 153.1 | 26.6 | 241.3 | 141.3 | 2132 |
| 22 | 19.6 | 130.2 | 25.5 | 227.3 | 149.4 | 1577 |
| 23 | 19.2 | 117.5 | 25.3 | 237.0 | 152.2 | 69 |
| 24 | 18.8 | 115.1 | 23.3 | 227.0 | 156.5 | — |
| Comp. O | 15.7 | 138.2 | 24.5 | 222.5 | 163.4 | 1281 |
| Comp. P | 19.6 | 108.5 | 25.9 | 225.1 | — | — |

Example 25 and Comparative Examples Q and R

The abrasive articles of Example 25 and Comparative Example Q were made according to General Procedure II for Making the Abrasive Articles. The formulation for Example 25 was prepared by mixing the following materials with an air driven stirrer: CER4 (100 parts), PH1 (2 parts) and 40 micrometer average particle size WAO (200 parts). The formulation for Comparative Example Q consisted of 40 micrometer average particle size WAO (200 parts), TMPTA (50 parts), TATHEIC (50 parts), and PH1 (1 part). Additionally, for both Example 25 and Comparative Example Q, curing was effected by exposure to one ultraviolet lamp at 300 Watts/inch at a rate of 2.7 m/min. The ultraviolet lamp was an "AETEK" lamp with an H bulb.

The abrasive article of Comparative Example R was 3M Grade 600 "WETORDRY Production Paper", A weight commercially available from Minnesota Mining and Manufacturing Co. (St. Paul, Minn.).

The abrasive articles were tested according to Test Procedures III through VI. The results are set forth in Tables 11 and 12.

TABLE 11

| | Test Procedure III | | | Test Procedure V | | |
|---|---|---|---|---|---|---|
| Example | Cut (g) | Ra | Peak | Cut (g) | Ra | Peak |
| 25 | 2.1 | 265 | 172 | 0.88 | 132 | 119.2 |
| Comp. Q | 0.76 | 17 | 117 | 0.67 | 11 | 77 |
| Comp. R | — | — | — | 0.23 | 8 | 47 |

TABLE 12

| | Test Procedure IV | | | Test Procedure VI | | |
|---|---|---|---|---|---|---|
| Example | Cut (g) | Ra | Peak | Cut (g) | Ra | Peak |
| 25 | 0.78 | 22.5 | 162 | 0.87 | 18 | 113 |
| Comp. Q | 0.41 | 15 | 120 | 0.26 | 12 | 76 |
| Comp. R | — | — | — | 0.23 | 4 | 21 |

Examples 26, 27 and 28

Ceramers CER5, CER6 and CER7 were all prepared without the addition of coupling agents. When CER6, a free-flowing liquid, was diluted with an equal weight of PETA, a hard chunky gel formed. This gel could not be processed any further to make a ceramer/abrasive grit composite (Example 27). By contrast CER3, which differed from CER6 only in having TMSPMA coupling agent, could be mixed with PETA without gel formation. This property was illustrated in Example 7.

When CER5 and CER7, both of which were free-flowing liquids, were each separately mixed with equal amounts of PETA, the resultant mixtures were fluid for a short time, but later turned into light greases. Therefore, it was necessary to prepare abrasive grit containing formulations from CER5 and CER7 immediately after mixing them with PETA.

When 29 parts of freshly mixed ceramer, consisting of 50 parts CER5 or CER7, 50 parts PETA, and 1 part PH2 were mixed with 1 part ASP and then 69 parts 40 micrometer WAO, the compositions became intractable slurries, and, in fact, did not wet out the abrasive grits after only about half of the 40 micrometer WAO was added (Examples 26 and 28).

Thus, it can be seen that functionalizing the surface of the silica particles of the ceramers with coupling agents (1) allows the ceramers to remain free-flowing when radiation crosslinkable monomers, such as PETA, are added, and (2) allows the mixture containing both ceramer and radiation crosslinkable monomer to more readily wet out the abrasive grits, thereby providing a coatable ceramer/abrasive grit/monomer mixture.

Comparative Example S

This example evaluates a crosslinkable organic binder filled with agglomerated colloidal silica that has not been treated with a coupling agent.

A mixture containing 50 parts NNDMA and 50 parts of a hydrophilic agglomerated form of colloidal silica ("CABOSIL M-5", available from Cabot Laboratories) was made. The agglomerated silica had a surface area of about 200 $m^2/g$, corresponding to individual agglomerated particles of 150 nm diameter. The resulting mixture was a free-flowing powder. A corresponding ceramer, CER3, which contained the same amount of silica, was a free-flowing liquid. The addition of 50 parts PETA to the NNDMA/agglomerated silica mixture continued to provide a powder, which was unsuitable for providing a coatable formulation when mixed with abrasive grits and 1 part TMSPMA (Comparative Example S).

By contrast, a mixture containing 29 parts of a CER3-/PETA ceramer (CER3/PETA produced from 30.8 parts 20 nm diameter silica sol particles, 30.8 parts NNDMA, 30.8 parts PETA, and 7.6 parts TMSPMA), one (1) part TMSPMA, 69 parts WAO, and one (1) part ASP, can provide a coatable formulation which, upon curing according to General Procedure II, provides an abrasive article.

Comparative Example T

This example evaluates a crosslinkable organic binder filled with agglomerated colloidal silica that has been treated with a coupling agent.

A mixture containing 50 parts NNDMA and 50 parts silica powder ("AEROSIL R972", available from DeGussa Co.) was made. The surface of the silica had been treated with MTMS coupling agent. The surface area of the treated silica was about 110 $m^2/g$ and the silica particles had an average diameter of 16 nm. The resulting mixture was a free-flowing powder. When 50 parts PETA and 1 part TMSPMA were added, the NNDMA/treated silica/PETA mixture continued to be a free-flowing powder (Comparative Example T).

By contrast,a mixture containing 29 parts CER11-/PETA crosslinkable ceramer of Example 15, 1 part TMSPMA, 69 parts WAO, and 2 parts ASP can provide a coatable formulation which, upon curing according to General Procedure II, provides an abrasive article.

Examples 29–37 and Comparative Examples U and V

To each 100 parts of the compositions shown in Table 13 was added one part PH2. The compositions containing the PH2, ceramer, and PETA amounted to 29 parts of the formulation for each example. Likewise, the composition containing TATHEIC/TMPTA amounted to 29 parts of the formulation for Comparative Example U. Other constituents of each formulation were 69 parts of P320 ALFSX brown aluminum oxide, 1 part ASP, and 1 part TMSPMA. Comparative Example V utilized a P320 ALFSX VE SA4 201E "THREE-M-ITE Resin-bond Cloth", JE weight Examples 29–37 and Comparative Example U were made according to the General Procedure III for Making the Abrasive Article. The rate of curing was 15 m/min. The articles were tested according to Test Procedure II. The results represent the average of two belts. The formulations for Examples 30 and 31 and Examples 34 and 35 were made up separately and coated separately in order to determine the repeatability of the results obtained. The values in Table 13 are in parts by weight.

The data in Table 14 show that all of the formulations containing ceramer outperformed Comparative Example U in total cut and that most of the formulations containing ceramer except Example 33 outperformed Comparative Example V in total cut. The two sets of repeated formulations, Examples 30 and 31, and Examples 34 and 35, show good reproducibility. For Examples 29–33, which used ceramer CER15, there was a dropoff in the total cut from 168.4 g to 124.3 g as the ceramer/PETA ratio decreased from 50:50 (Example 32) to 33.3:66.7 (Example 33). For Examples 34–37, which used CER2, there was no dropoff in cut, while the ceramer/PETA ratio ranged from 66.7:33.3 to 33.3:66.7.

TABLE 13

| | Example No. | | | | | | | | | |
|---|---|---|---|---|---|---|---|---|---|---|
| Ingredient | 29 | 30 | 31 | 32 | 33 | 34 | 35 | 36 | 37 | Comp. U |
| CER15 | 83.3 | 66.7 | 66.7 | 50 | 33.3 | | | | | |
| CER2 | | | | | | 66.7 | 66.7 | 50 | 33.3 | |
| TATHEIC(50%) TMPTA(50%) | | | | | | | | | | 100 |
| PETA | 16.7 | 33.3 | 33.3 | 50 | 66.7 | 33.3 | 33.3 | 50 | 66.7 | |

TABLE 14

| Ex. No. | Total Cut (g) | Initial Cut (g) | Ra (μin) | Peak (μin) |
|---|---|---|---|---|
| 29 | 176.2 | 19.4 | 35.0 | 321.8 |
| 30 | 160.3 | 19.4 | 35.9 | 322.9 |
| 31 | 167.8 | 19.5 | 34.4 | 294.1 |
| 32 | 168.4 | 19.2 | 32.9 | 277.4 |
| 33 | 124.3 | 18.9 | 30.9 | 278.0 |
| 34 | 159.9 | 19.6 | 30.9 | 260.0 |
| 35 | 163.4 | 20.2 | 31.6 | 251.9 |
| 36 | 164.2 | 20.1 | 30.0 | 251.9 |
| 37 | 169.9 | 20.9 | 33.3 | 279.9 |
| Comp. U | 120.4 | 16.9 | 27.9 | 238.5 |
| Comp. V | 145.3 | 23.5 | 27.8 | 238.5 |

Various modifications and alterations of this invention will become apparent to those skilled in the art without departing from the scope and spirit of this invention, and it should be understood that this invention is not to be unduly limited to the illustrative embodiments set forth herein.

What is claimed is:

1. An abrasive article comprising a plurality of abrasive grits and a binder comprising a cured ceramer, said ceramer comprising non-aggregated colloidal metal oxide particles provided as a sol and dispersed in a free-radically polymerizable composition.

2. The abrasive article of claim 1, wherein said colloidal metal oxide particles have an average particle size of from about 5 to about 1000 nanometers.

3. The abrasive article of claim 1, wherein said colloidal metal oxide particles have an average particle size of from about 10 to about 100 nanometers.

4. The abrasive of claim 1, wherein said ceramer further includes a coupling agent.

5. The abrasive of claim 4, wherein said colloidal metal oxide particles of said ceramer are functionalized by said coupling agent.

6. The abrasive of claim 4, wherein said coupling agent is a hydrolyzable silane.

7. The abrasive article of claim 1, wherein said polymerizable composition comprises a free-radically curable monomer having the formula:

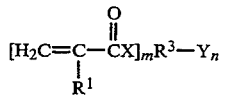

wherein $R^1$ represents a member selected from the group consisting of hydrogen, halogen, and lower alkyl group; X represents a member selected from the group consisting of oxygen and $—NR^2$, wherein $R^2$ represents hydrogen or lower alkyl group; $R^3$ represents a polyvalent organic group having a molecular weight of 14 to 1000 and a valence of m+n; m represents an integer designating the number of acrylic or methacrylic groups or both in the ester or amide; n represents an integer having a value of 1 to 5; and Y represents a member selected from the group consisting of hydrogen, lower alkyl group, and protic functional group.

8. The abrasive article of claim 1, wherein said polymerizable composition comprises a member selected from the group consisting of acrylated urethanes, acrylated epoxies, aminoplast derivatives having pendant unsaturated carbonyl groups, isocyanurate derivatives having at least one pendant acrylate group, isocyanate derivatives having at least one pendant acrylate group, epoxy resins other than acrylated epoxies, ethylenically unsaturated compounds other than acrylated urethanes, acrylated epoxies, acrylated isocyanates, or acrylated isocyanurates, and mixtures and combinations thereof.

9. The abrasive article of claim 1, wherein said abrasive grits are selected from the group consisting of aluminum oxide, alumina zirconia, silicon carbide, diamond, ceria, cubic boron nitride, garnet, and combinations thereof.

10. The abrasive of claim 1, wherein said ceramer further includes an additive selected from the group consisting of fillers, grinding aids, fibers, lubricants, antistatic agents, wetting agents, surfactants, pigments, dyes, plasticizers, and suspending agents.

11. The abrasive of claim 1, wherein said ceramer further includes a member selected from the group consisting of photoinitiators and photosensitizers.

12. The abrasive of claim 1, wherein said ceramer is substantially free of water.

13. The abrasive article of claim 1, wherein said article is selected from the group consisting of bonded abrasive articles, coated abrasive articles, and nonwoven abrasive articles.

14. A coated abrasive article comprising:

a. a backing;

b. abrasive grits;

c. a make coat that secures the abrasive grits to said backing;

d. a size coat overlying said abrasive and said make coat, wherein at least one of said make or said size coat comprises a cured ceramer said ceramer comprising non-aggregated colloidal metal oxide particles provided as a sol and dispersed in a free-radically polymerizable composition.

15. The coated abrasive article of claim 14, wherein said ceramer further includes a coupling agent.

16. The coated abrasive of claim 15, wherein said colloidal metal oxide particles of said ceramer are functionalized by said coupling agent.

17. The coated abrasive article of claim 15, wherein said coupling agent is a hydrolyzable silane.

18. The coated abrasive of claim 14, wherein said backing is selected from the group consisting of polymeric film, primed polymeric film, cloth, paper, vulcanized fiber, nonwoven substrates, treated nonwoven substrates, and combinations thereof.

19. The coated abrasive article of claim 14, wherein said abrasive particles are selected from the group consisting of aluminum oxide, alumina zirconia, silicon carbide, diamond, ceria, cubic boron nitride, garnet, and combinations thereof.

20. The coated abrasive article of claim 14, wherein at least one of said make coat or said size coat comprises an additive selected from the group consisting of fillers, grinding aids, fibers, lubricants, antistatic agents, wetting agents, surfactants, pigments, dyes, plasticizers, and suspending agents.

21. A coated abrasive article comprising a backing having a plurality of precisely shaped abrasive composites bonded to said backing, wherein said abrasive composites comprise a plurality of abrasive grits and cured ceramer said ceramer comprising non-aggregated colloidal metal oxide particles provided as a sol and dispersed in a free-radically polymerizable composition.

22. The coated abrasive article of claim 21, wherein said ceramer further includes a coupling agent.

23. The coated abrasive of claim 22, wherein said colloidal metal oxide particles of said ceramer are functionalized by said coupling agent.

24. The coated abrasive article of claim 22, wherein said coupling agent is a hydrolyzable silane.

25. The coated abrasive of claim 21, wherein said backing is selected from the group consisting of: polymeric film, primed polymeric film, cloth, paper, vulcanized fiber, nonwoven substrates, treated nonwoven substrates and combinations thereof.

26. The coated abrasive article of claim 21, wherein said abrasive grits are selected from the group consisting of aluminum oxide, alumina zirconia, silicon carbide, diamond, ceria, cubic boron nitride, garnet, and combinations thereof.

27. The coated abrasive article of claim 21, wherein said abrasive composite comprises an additive selected from the group consisting of fillers, grinding aids, fibers, lubricants, antistatic agents, wetting agents, surfactants, pigments, dyes, plasticizers, and suspending agents.

28. A coated abrasive article comprising a backing bearing on at least one major surface thereof a layer comprising a plurality of abrasive grits and a binder comprising a cured ceramer said ceramer comprising non-aggregated colloidal metal oxide particles provided as a sol and dispersed in a free-radically polymerizable composition.

29. The coated abrasive article of claim 28, wherein said ceramer further includes a coupling agent.

30. The coated abrasive of claim 29, wherein said colloidal metal oxide particles of said ceramer are functionalized by a coupling agent.

31. The coated abrasive article of claim 29, wherein said coupling agent is a hydrolyzable silane.

32. The coated abrasive article of claim 28, wherein said backing is selected from the group consisting of:

polymeric film, primed polymeric film, cloth, paper, vulcanized fiber, nonwoven substrates, treated nonwoven substrates and combinations thereof.

33. The coated abrasive article of claim 28, wherein said abrasive grits are selected from the group consisting of aluminum oxide, alumina zirconia, silicon carbide, diamond, ceria, cubic boron nitride, garnet, and combinations thereof.

34. The coated abrasive article of claim 28, wherein said abrasive composite comprises an additive selected from the group consisting of fillers, grinding aids, fibers, lubricants, antistatic agents, wetting agents, surfactants, pigments, dyes, plasticizers, and suspending agents.

* * * * *

UNITED STATES PATENT AND TRADEMARK OFFICE

CERTIFICATE OF CORRECTION

PATENT NO. : 5,391,210
DATED : February 21, 1995
INVENTOR(S) : Zayn Bilkadi and Thomas P. Klun It is certified that error appears in the above-indentified patent and that said Letters Patent is hereby corrected as shown below:

Col. 18, line 46, after "Example" insert --10)--.

Col. 19, line 14, after "weight" insert --.--.

Col. 22, line 1, after "weight" insert --.--.

Col. 22, line 67, after "abrasive" insert --article--.

Col. 23, line 1, after "abrasive" insert --article--.

Col. 23, line 4, after "abrasive" insert --article--.

Col. 23, line 44, after "abrasive" insert --article--.

Col. 23, line 49, after "abrasive" insert --article--.

Col. 23, line 52, after "abrasive" insert --article--.

UNITED STATES PATENT AND TRADEMARK OFFICE

CERTIFICATE OF CORRECTION

PATENT NO. : 5,391,210

DATED : February 21, 1995

INVENTOR(S) : Zayn Bilkadi and Thomas P. Klun

It is certified that error appears in the above-indentified patent and that said Letters Patent is hereby corrected as shown below:

Col. 24, line 3, after "abrasive" insert --article--.

Col. 24, line 8, after "abrasive" insert --article--.

Col. 24, line 33, after "abrasive" insert --article--.

Col. 24, line 38, after "abrasive" insert --article--.

Col. 24, line 62, after "abrasive" insert --article--.

Signed and Sealed this

Thirteenth Day of June, 1995

*Attest:*

Bruce Lehman

BRUCE LEHMAN

*Attesting Officer*

*Commissioner of Patents and Trademarks*